US007172168B1

(12) United States Patent
Kallas

(10) Patent No.: US 7,172,168 B1
(45) Date of Patent: Feb. 6, 2007

(54) UMBRELLA HOLDER

(76) Inventor: Ryan David Kallas, 4 Lake Shore Ct., Richmond, CA (US) 94804

( * ) Notice: Subject to any disclaimer, the term of this patent is extended or adjusted under 35 U.S.C. 154(b) by 0 days.

(21) Appl. No.: 10/698,738

(22) Filed: Oct. 30, 2003

(51) Int. Cl.
*F16M 13/00* (2006.01)

(52) U.S. Cl. ..... 248/530; 248/522; 248/511; 135/16; 52/157

(58) Field of Classification Search ..... 248/522, 248/511, 523, 512, 530, 513, 532, 534, 545, 248/539, 518, 519, 524, 527, 529, 533, 548, 248/156, 55, 314; 135/16, 15.1, 21; 52/156
See application file for complete search history.

(56) References Cited

U.S. PATENT DOCUMENTS 2,643,843 A * 6/1953 Brown ..... 248/156
3,285,554 A * 11/1966 Voelkerding ..... 248/121
3,318,560 A * 5/1967 Garrette, Jr. et al. ..... 248/545
4,748,762 A * 6/1988 Campbell ..... 43/212
4,832,304 A * 5/1989 Morgulis ..... 248/533
5,749,386 A * 5/1998 Samuel, Jr. ..... 135/16
6,199,819 B1 * 3/2001 Churillo ..... 248/540

* cited by examiner

*Primary Examiner*—Kimberly Wood
(74) *Attorney, Agent, or Firm*—Risto A. Rinne, Jr.

(57) ABSTRACT

An apparatus for holding an umbrella includes a longitudinal shaft with a lower and an upper end. The lower end is adapted for insertion into the ground. A pivoting lever is used to urge the lower end into the ground by stepping on it. The upper end is adapted to receive and retain a lower end of the umbrella. An intermediate support is provided between the upper and lower ends and is used to steady the apparatus, for example, in the wind.

17 Claims, 8 Drawing Sheets

FIG.6
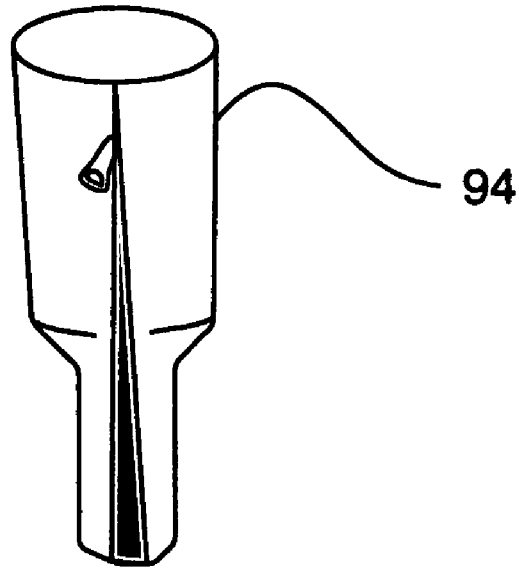
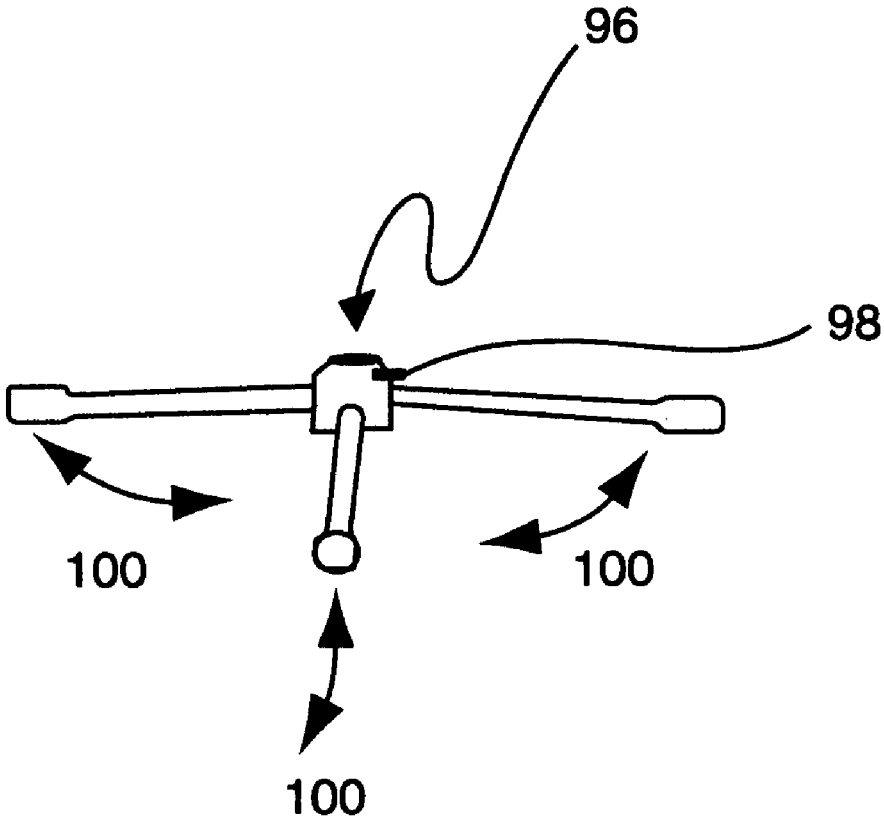
FIG.7

UMBRELLA HOLDER

BACKGROUND OF THE INVENTION

1. Field of the Invention

The present invention, in general relates to umbrellas and, more particularly, to a device for securing an umbrella thereto in an open position, adapted for use.

There are many situations in which it is desirable to hold an umbrella open, ready for use, so that people can stand under the umbrella. They may desire relief from either rain or sun.

There are many places where such benefit is desired. For example, tennis, gardening, camping, hiking, picnicking are a few instances. One such place of especial import is on the golf course. There, a golfer puts an umbrella in his golf bag and carries it around. If its use is desired, the golfer must either hold the umbrella open (by hand) or somehow attach it to the golf bag, which is most unstable.

Also, the golfer (user) cannot readily stand under the umbrella.

Furthermore, different umbrellas have handles of different diameters, different thicknesses of shafts, different length shafts, etc. Accommodating these variables has presented an obstacle.

Also, the surface may vary, from soft, wet earth under grass to an asphalt or concrete surface in which an open umbrella is to be held.

There may also be a breeze or even a slight wind present which makes retention of an umbrella, which acts as an airfoil, difficult to accomplish.

Accordingly there exists today a need for an apparatus and method for holding an umbrella.

Clearly, such an apparatus would be a useful and desirable device.

2. Description of Prior Art

Umbrellas are, in general, known. However, umbrella holders of the type herein described are not known. While the structural arrangements of the above described know types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an umbrella holder that can be inserted into the soil.

It is also an important object of the invention to provide an umbrella holder that is adapted to secure an umbrella thereto.

Another object of the invention is to provide an umbrella holder that is adapted to secure one end of an umbrella thereto.

Still another object of the invention is to provide an umbrella holder that includes means for urging one end of the holder into the ground.

Still yet another object of the invention is to provide an umbrella holder that is adapted for use on a hard (impervious) surface.

Yet another important object of the invention is to provide an umbrella holder that includes an additional securement along a length of the holder.

Still yet another important object of the invention is to provide an umbrella holder that is adapted to retain different sizes or types of umbrellas.

A first continuing object of the invention is to provide an umbrella holder that allows the umbrella to be in an open position.

A second continuing object of the invention is to provide an umbrella holder that resists movement due to fluctuations in the wind.

A third continuing object of the invention is to provide an umbrella holder that includes a telescoping shaft.

A fourth continuing object of the invention is to provide an umbrella holder that is adapted for insertion into a golf bag.

A fifth continuing object of the invention is to provide an umbrella holder that includes accessories for attachment to a golf bag.

A sixth continuing object of the invention is to provide an umbrella holder that can be readily secured to a golf bag and readily removed from the golf bag during use.

A seventh continuing object of the invention is to provide an umbrella holder that can be inserted into a golf bag for storage.

An eighth continuing object of the invention is to provide an umbrella holder that can be inserted into a golf bag for storage and which includes a cover thereby appearing as another golf club in the golf bag.

A ninth continuing object of the invention is to provide an umbrella holder that includes a longitudinal shaft that can be disposed at an angle other than normal with respect to the ground.

A tenth continuing object of the invention is to provide an umbrella holder that is adapted for use with a sports umbrella.

Briefly, an umbrella holder that is constructed in accordance with the principles of the present invention has a longitudinal shaft with a lower and an upper end. The lower end is adapted for insertion into the ground. A pivoting lever is used to urge the lower end into the ground by stepping on it. The upper end is adapted to receive and retain a lower end of an umbrella. Various accessory devices are described that, among other things, secure the longitudinal shaft to an object such as to a golf bag or a chair, cover the upper end, or adapt the lower end for use on a solid surface.

BRIEF DESCRIPTION OF THE DRAWINGS

FIG. 6 is a view in perspective of a cover for the cup assembly of the umbrella holder of FIG. 1.

FIG. 7 is a view in perspective of a tripod assembly for securing a lower end of the umbrella holder of FIG. 1.

DETAILED DESCRIPTION OF THE INVENTION

Figure 1:
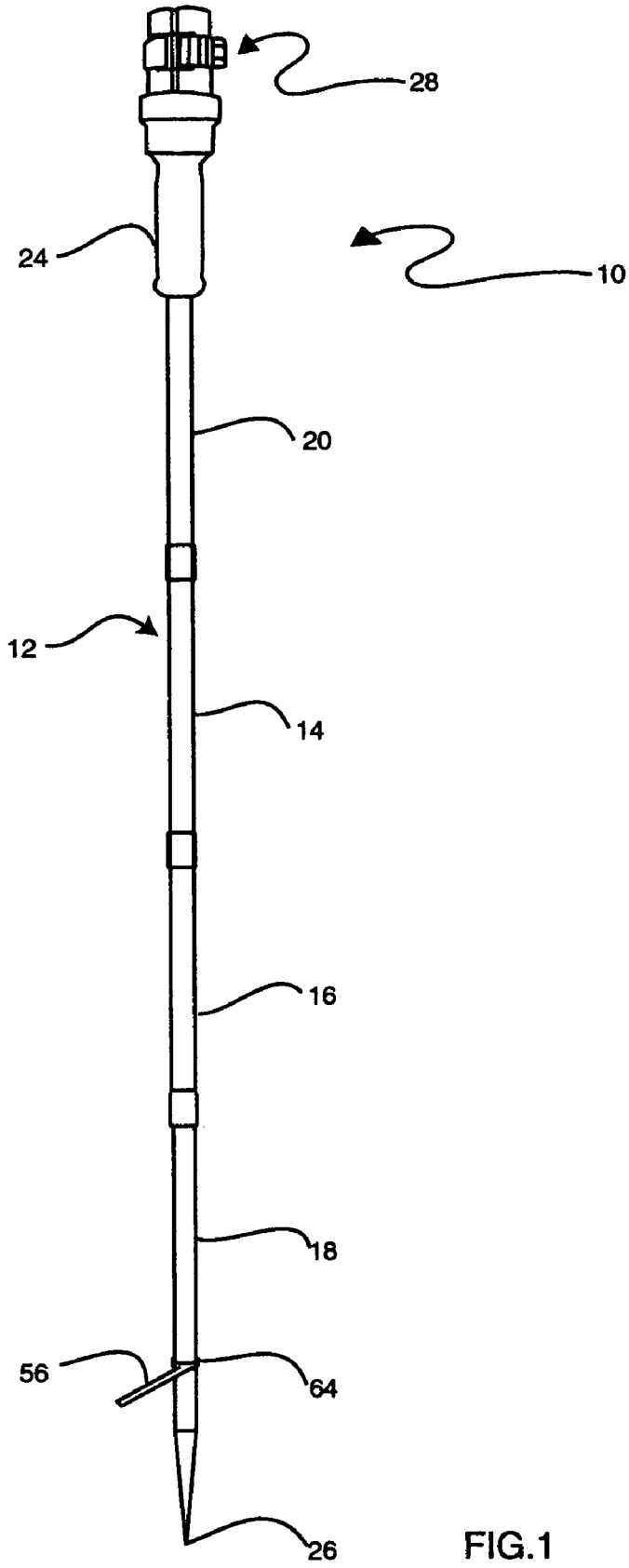
FIG. 1 is side view of an umbrella holder with a telescoping shaft in an extended position.

Referring on occasion to all of the drawing figures and now in particular to FIG. 1 is shown, an umbrella holder, identified in general by the reference numeral 10.

The umbrella holder 10 includes a longitudinal shaft, identified in general by the reference numeral 12.

The shaft 12 includes a plurality of telescoping segments 14–18, with segment 14 telescoping in and out of a main segment 20. Segment 16 telescopes in and out of segment 14. Segment 18 telescopes in and out of segment 16.

Figure 3:
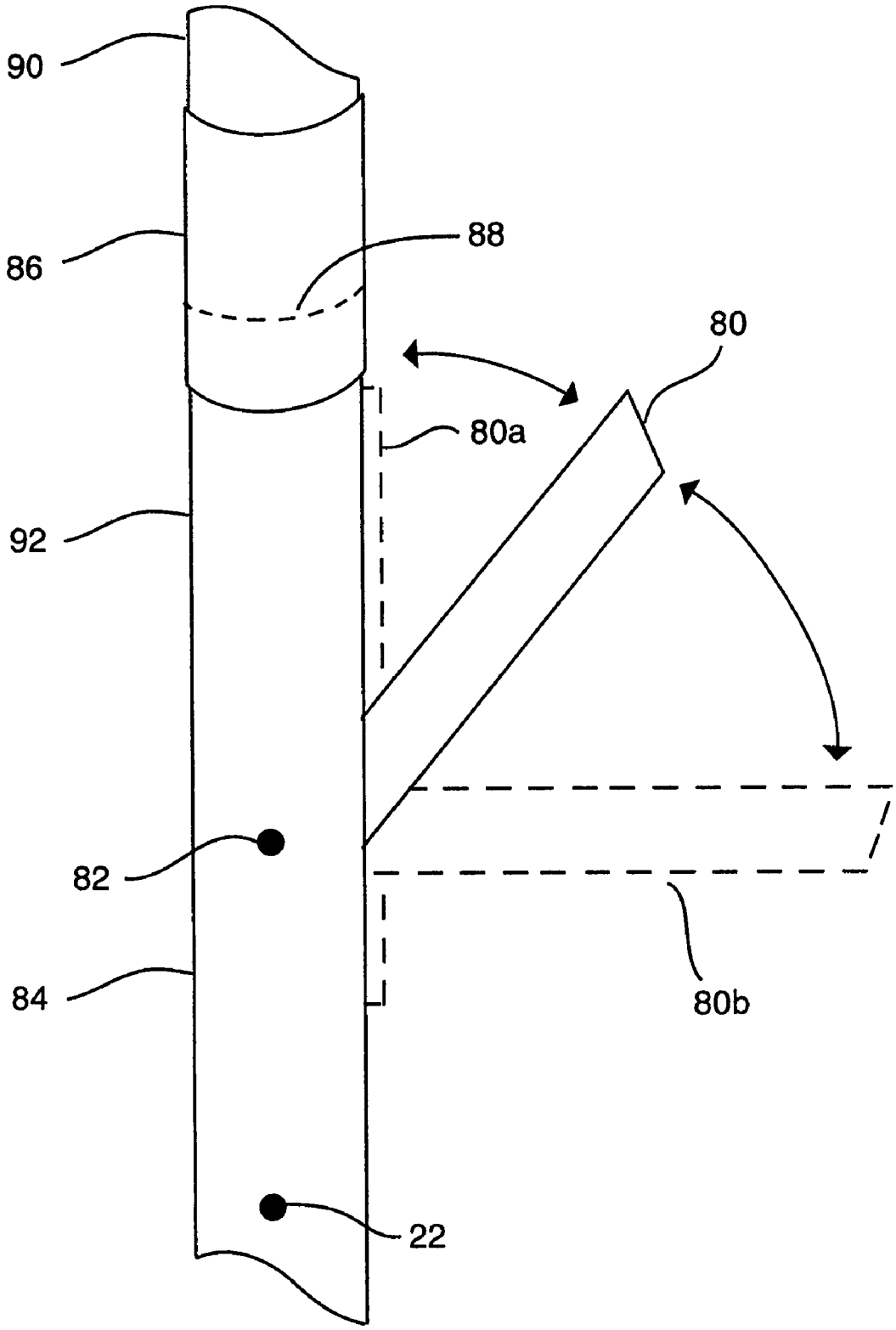
FIG. 3 is an enlarged view in perspective of a modified type of a pivoting lever of a modified umbrella holder.

The segments 14–18 twist and lock in place or are secured by a spring loaded pin 22 (see FIG. 3). The spring loaded pin 22 snaps into a hole in one of the segments to secure it in position when extended (or retracted) and is a known type of locking mechanism as is a twist and lock in place type of mechanism.

A grip 24 covers a portion of the main segment 20 and provides a convenient hand hold that can be used to insert a lower end 26 of the umbrella holder 10 in a ground surface 27 (FIG. 8), as is described in greater detail hereinafter.

Figure 5:
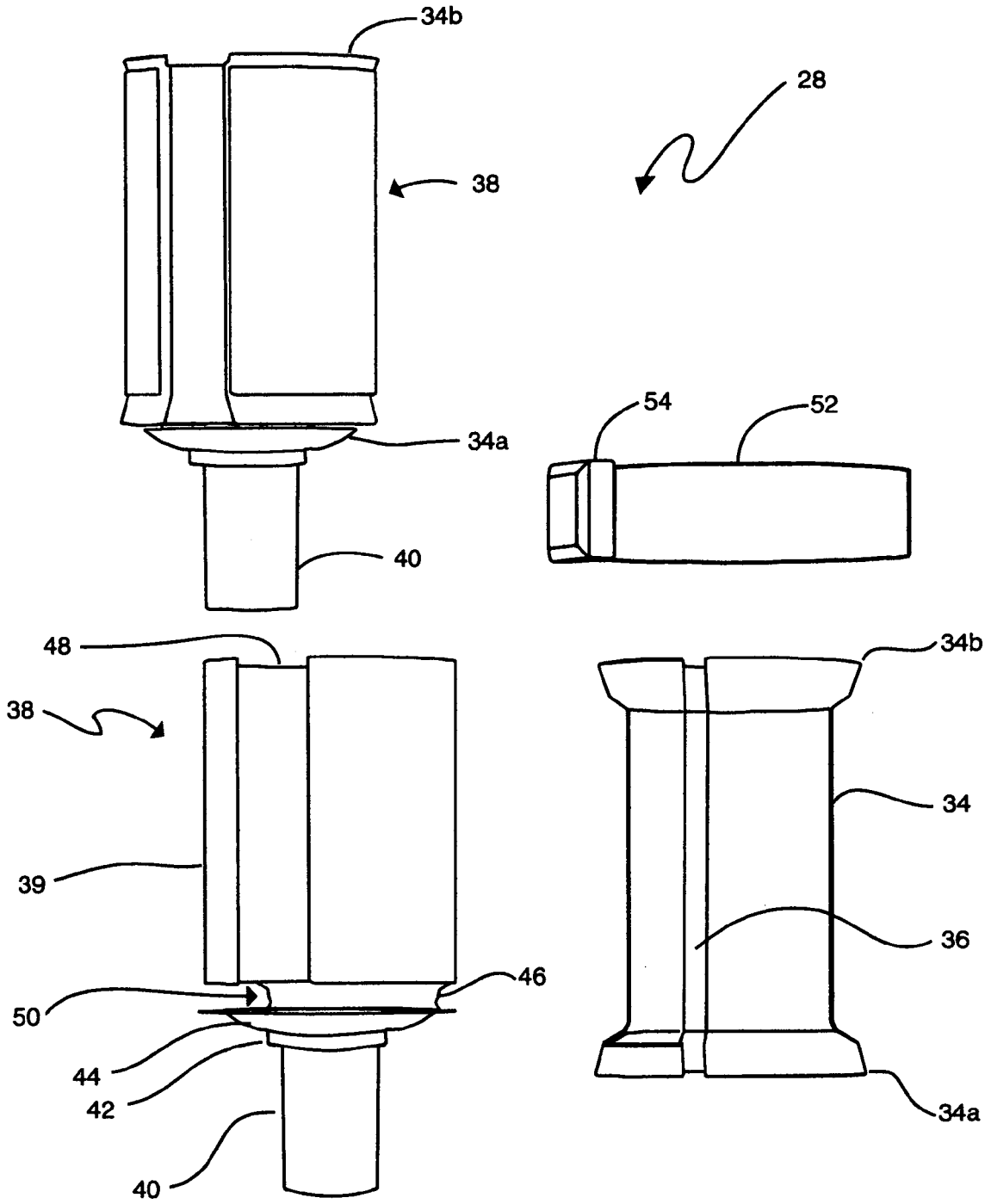
FIG. 5 is a view in perspective of the component parts of a cup assembly of the umbrella holder of FIG. 1 that is adapted to receive an end of an umbrella therein.
Figure 8:
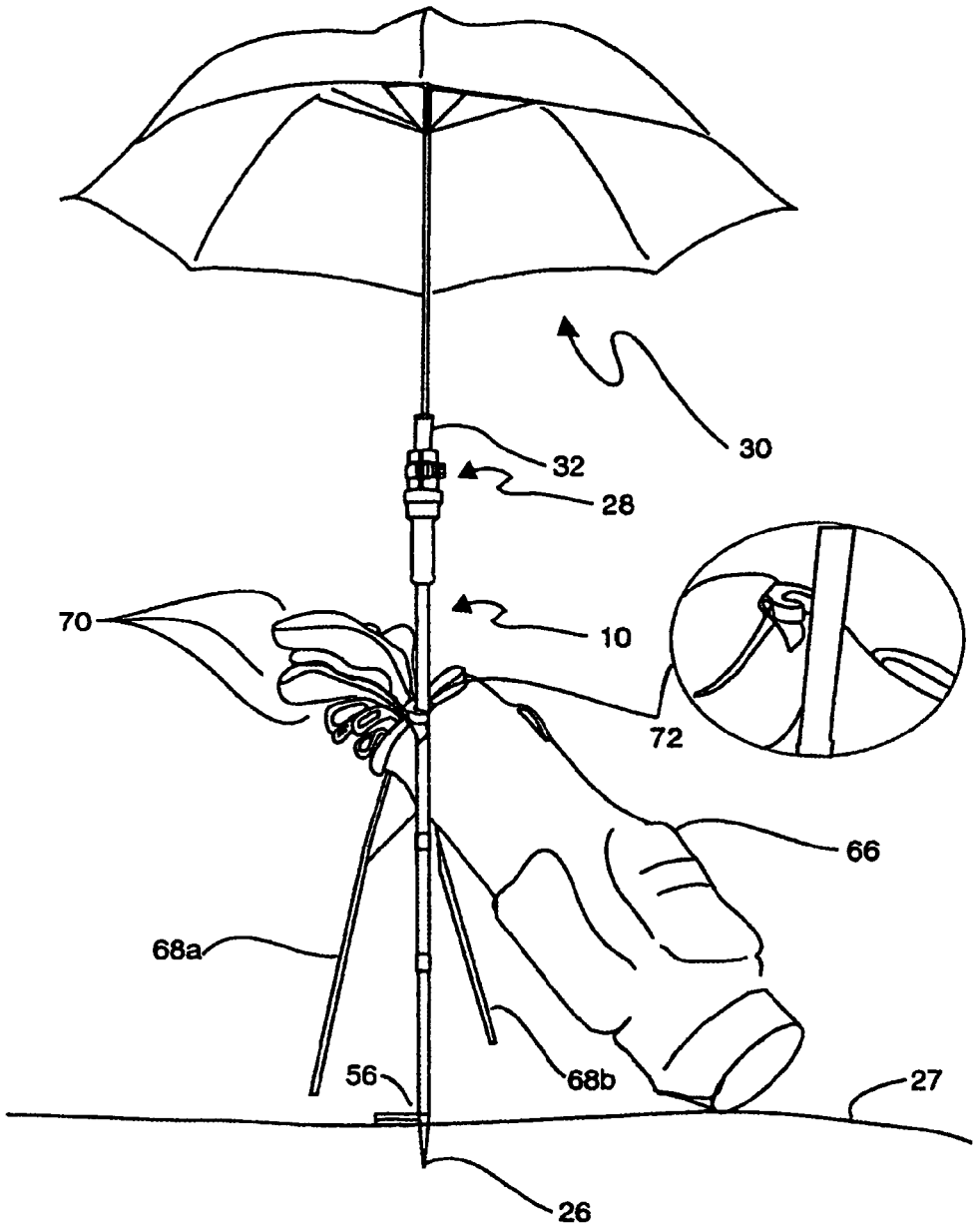
FIG. 8 is a view in perspective of the umbrella holder of FIG. 1 secured to a golf bag and partially embedded in the ground for use.

Referring now also to FIG. 5 and FIG. 8, is shown a cup assembly, identified in general by the reference numeral 28. The cup assembly 28 is adapted to receive a lower end of an umbrella 30. The lower end of the umbrella 30 typically includes an umbrella handle grip 32. The size of the handle grip 32 will vary depending upon the make and model of the umbrella 30. Therefore, it is important that the cup assembly 28 be capable of securing most handle grip 32 sizes, or if the handle grip 32 is omitted, the lower end of most umbrellas 30.

The cup assembly 28 includes a resilient insert 34. The resilient insert 34 includes a split 36 along its longitudinal length. The split 36 includes a gap between each side thereof to allow it to tighten around the handle grip 32, as is explained in greater detail hereinafter.

The resilient insert 34 is made of any resilient material, as desired, including foams, rubbers, etc. It includes a preferred overall length of approximately 5.5 inches and preferably includes tapered ends 34*a*, 34*b*, as shown, that extend outward away from a smaller diameter center section.

The resilient insert 34 is inserted into an outer sheath 38 assembly. The outer sheath assembly 38 includes a short cylindrical segment 40 that is adapted for insertion into the upper end of the main segment 20. If desired, the cylindrical segment 40 could of course be inserted over the upper end of the main segment 20. While the size of any component part may be varied as desired, a preferred length for the cylindrical segment 40 is approximately three inches and a preferred diameter is approximately 0.708 inches.

An O-ring 42 is disposed over the cylindrical segment 40 and rests atop the main segment 20.

A circular base 44 of the cup assembly 28 is attached to the top of the cylindrical segment 40 and it provides a base upon which a bottom end of the resilient insert 34 rests, and also upon which the lower end of the umbrella 30 or a bottom of the umbrella handle grip 32 rests during use.

A circular member 46 is attached to a perimeter of the circular base 44. The circular member 46 extends in a circle around the outside of the circular base 44 for an amount that is preferably less than one-half the circumference of the circular base 44. This is to allow the cup assembly 28 to grip the lower end of the umbrella 30 (or handle grip 32) as is described in greater detail below.

A flexible outer sheath 39 is attached along a portion of its bottom to the circular member 46. The flexible outer sheath 39 extends in a circle also around the perimeter of the circular base 44. A second split 48 extends down the longitudinal length of the flexible outer sheath 39 at a location that is disposed maximally away from where the flexible outer sheath 39 is attached to the circular member 46.

The portion of the flexible outer sheath 39 that is attached to the circular member 46 is maintained by the circular member 46 in position with respect to the circular base 44. Accordingly, that portion of the flexible outer sheath 39 is not especially flexible.

However, the remainder of the flexible outer sheath 39 that extends on each side of the circular member 46 to the second split 48 is adapted to flex along an arc wherein it can change its circumference while maintaining rigidity along its longitudinal length. This allows the ends of the flexible outer sheath 39 to be tightened into a smaller circumference, as is described in greater detail hereinbelow, sufficient to squeeze the resilient insert 34 onto the handle grip 32 or the lower end of the umbrella 30.

A small gap 50 is provided between the bottom of the ends of the flexible outer sheath 39 and the top of the circular base 44. The small gap 50 is equal in size to the height of the circular member 46 because the circular member 46 elevates the flexible outer sheath 39 above the circular base 44 by its own thickness. The small gap 50 is useful in preventing the flexible outer sheath 39 from binding against the circular base 44 as its circumference is decreased during the tightening process, as described below.

A ratchet strap 52 that includes a lever assembly 54 for tightening or loosening and it is placed around the flexible outer sheath 39 when the flexible outer sheath 39 is loose and relatively open. The ratchet strap 52 extends in a circle that begins and ends at the lever assembly 54.

In use, the resilient insert 34 is inserted into the flexible outer sheath 39. The handle grip 32 or the lower end of the umbrella 30 is then inserted in the resilient insert 34. Different types of the resilient insert 34 can be provided to optimally match the size and contour of the handle grip 32 or of the lower end of the umbrella 30, as desired. The ratchet strap 52 is tightened an amount sufficient to compress the flexible outer sheath 39 until the umbrella 30 is secured in position.

As the flexible outer sheath 39 is compressed its overall circumference is decreased. As this occurs, it also bears on the resilient insert 34 thereby also decreasing the overall circumference of the resilient insert 34.

As this happens, an open center of the resilient insert 34 (i.e., where the handle grip 32 or the lower end of the umbrella 30 is now disposed) tightens around the handle grip 32 or lower end of the umbrella 30 sufficient to retain it in position, even when the umbrella 30 is open.

The action provided by the outer sheath assembly 38 mimics that of a hand (not shown) securely grasping the handle grip 32 or the lower end of the umbrella 30. This frees the hands of the user for more preferential activities.

The lever assembly 54 is used to tighten or loosen the ratchet strap 52, as desired. To remove the umbrella 30, the lever assembly 54 is used to loosen the ratchet strap 52. There are numerous off the shelf products that can be used as the ratchet strap 52 and the instant invention is not limited to any particular type. Some of these products may or may not include a "ratchet" type of action, however all are able to sufficiently tighten the flexible outer sheath 39 to secure the umbrella 30 within the sheath assembly 38.

In use, the segments 14–18 are opened by either twisting them open, sliding one or more of them into an extended position, and locking them in place by twisting them tight or alternately, they may each be secured by the spring loaded pin 22 passing through a hole. The pin 22 is depressed to close the segments 14–18 and expands into the hole when the segments 14–18 are extended and align with the pin 22.

The umbrella holder 10 is then disposed in a generally upright position with the lower end 26 in contact with the ground 27.

Figure 2:
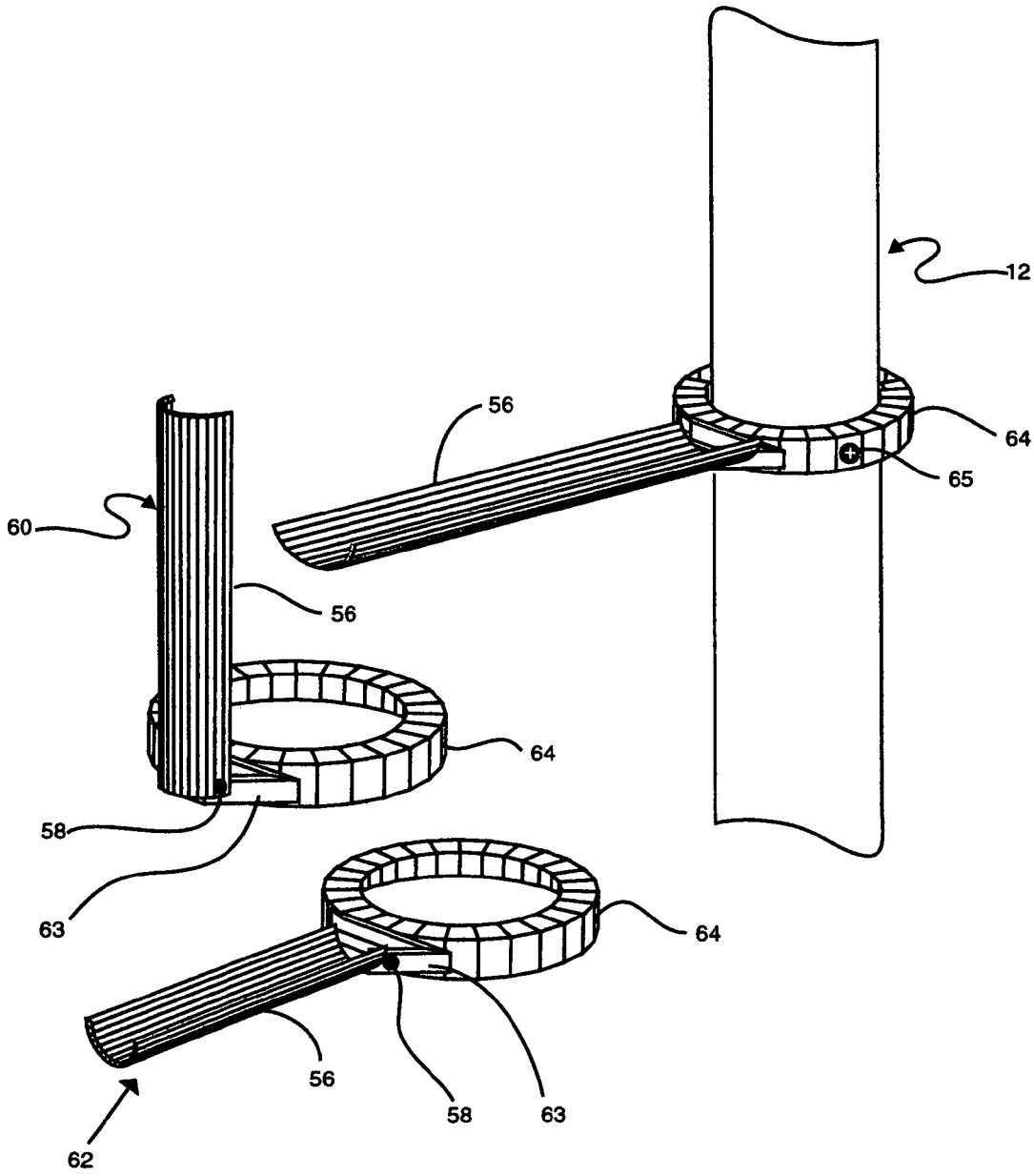
FIG. 2 is an enlarged view in perspective of a pivoting lever of the umbrella holder of FIG. 1.

A pivoting lever 56 (see also FIG. 2) pivots about a hinge 58 from a first position 60 into a second position 62. The first position 60 disposes the lever 56 in a vertical position, adjacent to the longitudinal shaft 12. The first position 60 is used form transport.

The second position 62 disposes the lever 56 in a horizontal position, substantially perpendicular with respect to the longitudinal shaft 12. The lever 56 is urged by hand or by the heel of a shoe (not shown) from the first position 60 into the second position 62 and back again as desired.

When in the second position 62, a bottom of the lever 56 contacts a stop member 63 that is attached to a circular ring 64. The stop member 63 making contact with the bottom of the lever 56 prevents the lever 56 from pivoting further in a downward direction.

The longitudinal shaft 12 must taper if the segments 14–18 are used where one segment is disposed within an adjoining segment. Accordingly, the bottom segment 18 is the smallest and it includes a tapered end leading to a pointed tip at the lower end 26.

The circular ring 64 is urged up from the lower end 26 until the increasing taper of the bottom segment 18 produces a large enough diameter so that the circular ring 64 cannot move further up the shaft 12. An additional force may be all that is needed to retain it in place. If desired, it can be permanently attached by welding, adhesive, or it may be detachably attached by the use of a set screw 65 passing through the circular ring 64.

To insert the lower end 26 into the ground, the lever 56 is urged into the second position 62 and is stepped on by the user to push the lower end 26 into the ground to a depth that is desired. This can, of course, be accomplished either before or after the umbrella 30 has been secured to the cup assembly 28.

It is necessary to provide yet an additional support for the umbrella holder 10 that is disposed along some portion of the longitudinal length of the shaft 12 between the cup assembly 28 and the circular ring 64. In some instances, the shaft 12 may merely be angled so as to lean on an object, for example a golf bag 66 (FIG. 8). It is important to note that the golf bag 66 has a pair of stabilizing hinged legs 68*a*, 68*b* and is itself inherently stable, being supported in an upright position by the legs 68*a*, 68*b* and by the weight of a plurality of golf clubs 70 that are placed therein.

Figure 4:
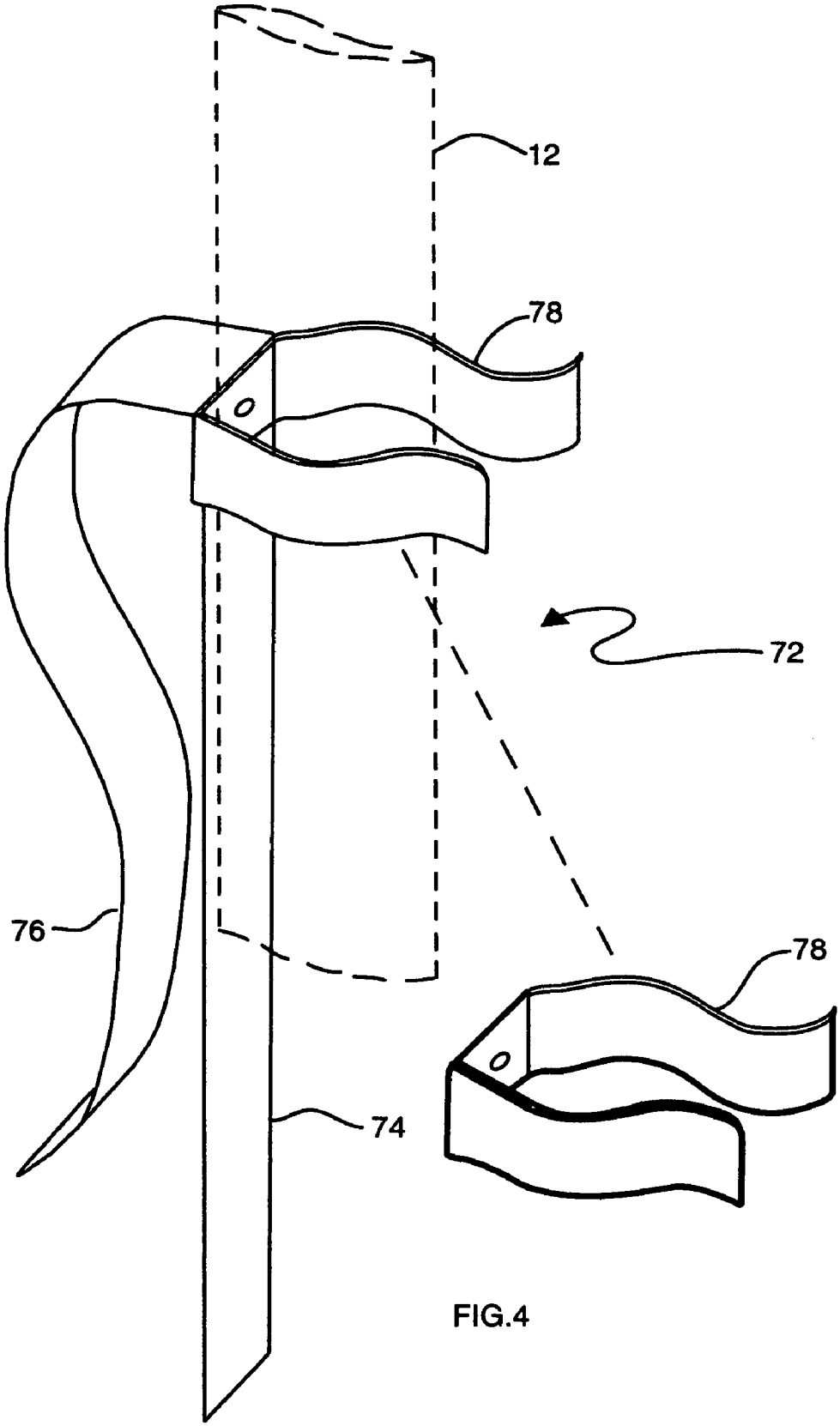
FIG. 4 is a view in perspective of a clip used to secure the shaft of the umbrella holder is an enlarged view in perspective of a pivoting lever of the umbrella holder.

A preferred support is provided by a clip 72 (FIG. 4) that is placed over an intended object, in this example, over an outside edge of the golf bag 66.

The clip 72 includes a straight member 74 and a curved member 76. The straight member 74 is disposed outside the golf bag 66 and the curved member 76 is placed inside of the bag 66, with the golf bag 66 sandwiched between the two. A U-shaped member 78 is attached to the clip 72 and is adapted to surround a portion of the longitudinal shaft 12 and retain it thereto.

Accordingly, the golf bag 66 supports the umbrella holder 30. Other objects can of course be substituted for the golf bag 66.

Referring now momentarily to FIG. 3, a modified pivoting lever 80 includes a center pin 82 that passes through a modified shaft 84 of a modified umbrella holder (shown only in part).

The modified pivoting lever 80 is adapted to pivot from a modified first position 80*a* for transport into a modified second position 80*b* for insertion into the ground. Stops (not shown) on the rear of the modified shaft 84 prevent the modified lever 80 from moving past either the modified first or modified second positions 80*a*, 80.

A modified way to extend or retract the length of the modified shaft 84 is shown by a sliding collar 86 that is adapted to slide along the longitudinal length of the modified shaft 84 sufficient to cover or open a seam 88 between a modified first segment 90 and a modified second segment 92. When the collar 86 covers the seam 88, the two segments 90, 92 are retained in a linear arrangement.

Referring to FIG. 6, a covering 94 may be placed over the cup assembly 28 when the umbrella 30 is not used. The umbrella holder 10 may be shortened by decreasing the length of any of the segments 14–18 so that its overall length approximates that of the golf clubs 70. Then, when the umbrella holder 10 is placed in the golf bag 66, it resembles any of the golf clubs 70.

Referring to FIG. 7, a tripod 96 is provided for use on hard (i.e., impermeable) surfaces, like asphalt or cement. The lower end 26 is placed in a center of the tripod 96 and is secured thereto by a tripod set screw 98. The legs of the tripod 96 fold in and out as shown by three arrows 100 for compact storage and transport.

Figure 9:
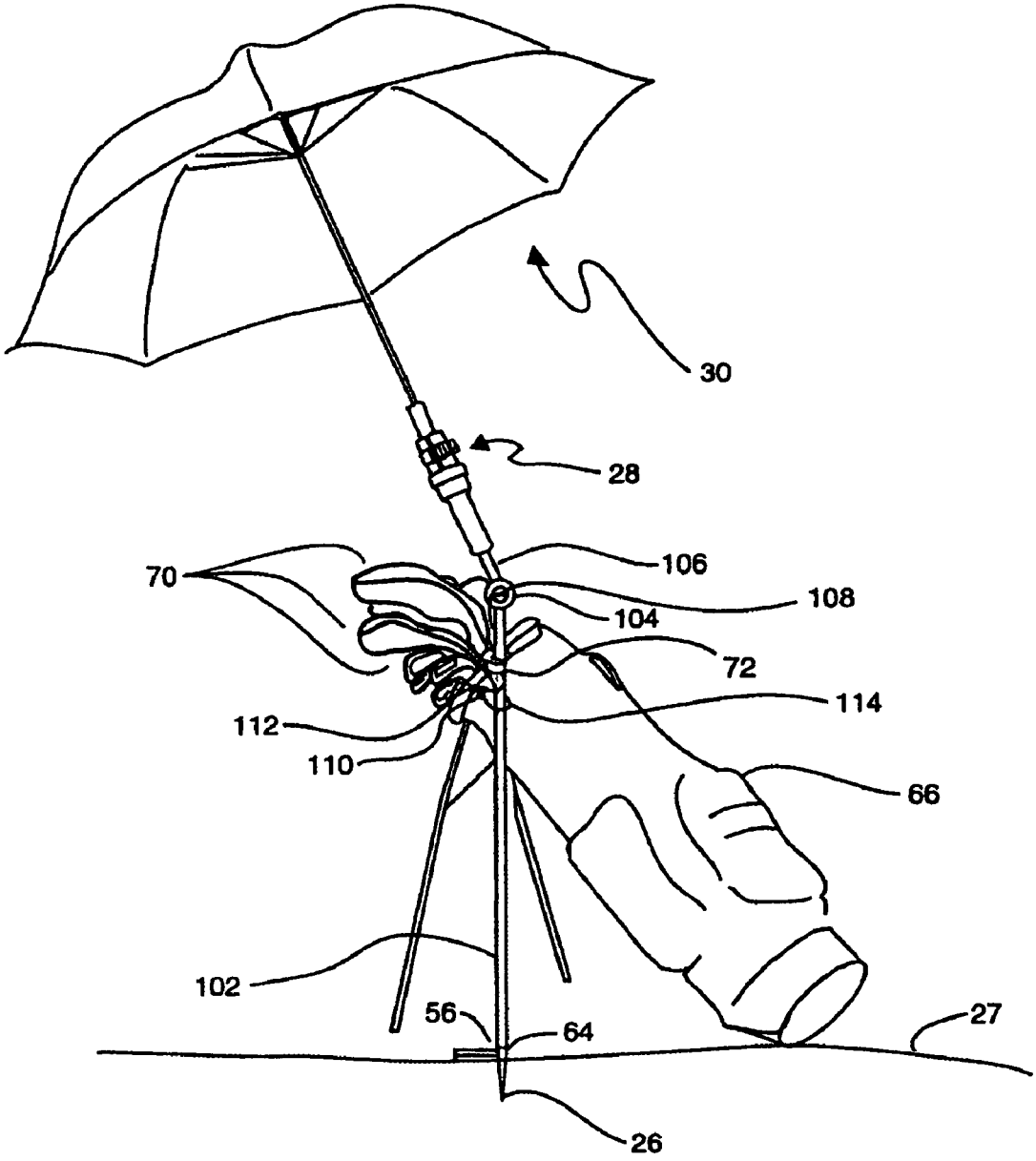
FIG. 9 is a view in perspective of a modified umbrella holder.

Referring to FIG. 9, a second modified shaft 102 is non-segmented. The non-segmented second modified shaft 102 does not separate into smaller segments nor does is telescope. Its advantage is ease of manufacture and strength.

An adjustable pivot member 104 includes a first half attached to a bottom member 106 and a second half attached to the bottom of the second modified shaft 102. The first half and second half are adjacent to each other and include a hole passing through both. A bolt and wing nut 108 is used to tighten the first half to the second half where desired. This introduces any desired angle between the bottom member 106 and the second modified shaft 102 thereby permitting an angling of the second modified shaft 102 as desired. This may be useful to take better advantage of the umbrella 30 for optimum shade.

Referring again to FIG. 9, a pair of clasps 110 are attached to a ring 112 provided on the golf bag 66. A cord 114 is disposed intermediate the two clasps 110 and adapted to encircle the second modified shaft 102 sufficient to retain it proximate the golf bag 66.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An umbrella holder, comprising:

(a) a shaft having an upper and a lower end; and (b) means for attaching an umbrella to said shaft; and wherein said means for attaching an umbrella to said shaft includes means for attaching said umbrella to an upper end of said shaft and wherein said means for attaching said umbrella to an upper end of said shaft includes a cup assembly attached to said upper end, said cup assembly adapted to receive a lower portion of a handle of said umbrella therein, and wherein said cup assembly includes a flexible outer sheath and a resilient insert disposed in said flexible outer sheath, said resilient insert including a center opening adapted to receive said lower portion of said handle and including means for compressing said flexible outer sheath over said resilient insert sufficient to retain said lower portion of said handle therein.

2. The umbrella holder of claim 1, wherein said shaft includes a solid shaft.

3. The umbrella holder of claim 1, wherein said shaft includes a segmented shaft.

4. The umbrella holder of claim 3, wherein said segmented shaft includes at least one segment that is adapted to telescope in and out of another segment.

5. The umbrella holder of claim 3, wherein said segmented shaft includes at least two segments and a collar that is adapted to retain said at least two segments in linear alignment with each other when said collar is disposed over a seam intermediate said at least two segments.

6. The umbrella holder of claim 3, wherein said segmented shaft includes means for retaining at least two segments in an extended position.

7. The umbrella holder of claim 6 wherein said means for retaining includes a pin in a first of said at least two segments adapted to pass through a hole in a remainder of said at least two segments sufficient to retain said at least one of said at least two segments in said extended position with respect to the other segment.

8. The umbrella holder of claim 1, wherein said shaft includes at least two segments and including means for varying an angle intermediate said at least two segments.

9. The umbrella holder of claim 1, wherein said shaft includes means for inserting a portion of said lower end into the ground.

10. The umbrella holder of claim 9 wherein said means for inserting includes a lever operatively attached to said shaft, wherein said lever is adapted to be stepped on sufficient to urge said portion of said lower end into the ground.

11. The umbrella holder of claim 10 wherein said lever is adapted to pivot from a first position where a longitudinal axis of said lever is in parallel alignment with respect to a longitudinal axis of said shaft into a second position where said longitudinal axis of said lever is in perpendicular alignment with respect to said longitudinal axis of said shaft.

12. The umbrella holder of claim 11 including a ring adapted to surround said shaft and wherein said lever is pivotally attached to said ring.

13. The umbrella holder of claim 1 wherein said means for compressing includes a band disposed around an exterior circumference of said flexible outer sheath, said band including means for decreasing an overall length thereof sufficient to compress said flexible outer sheath.

14. The umbrella holder of claim 1 including means for supporting said shaft at a location intermediate said upper end and said lower end.

15. The umbrella holder of claim 14 wherein said means for supporting said shaft includes a clip that is adapted to be attached to an object and to retain said shaft thereto.

16. The umbrella holder of claim 1 including a cover, said cover adapted to protect a portion of said upper end.

17. A method for holding an umbrella, comprised of the steps of:

(a) providing an umbrella holder that includes a shaft having an upper and a lower end and means for attaching said umbrella to said shaft;

(b) inserting a portion of said lower end into the ground; and (c) providing means for supporting said shaft at a location intermediate said upper end and said lower end, and wherein said means for attaching said umbrella to said shaft includes means for attaching said umbrella to an upper end of said shaft and wherein said means for attaching said umbrella to an upper end of said shaft includes a cup assembly attached to said upper end, said cup assembly adapted to receive a lower portion of a handle of said umbrella therein, and wherein said cup assembly includes a flexible outer sheath and a resilient insert disposed in said flexible outer sheath, said resilient insert including a center opening adapted to receive said lower portion of said handle and including means for compressing said flexible outer sheath over said resilient insert sufficient to retain said lower portion of said handle therein.

* * * * *